United States Patent [19]

Jones

[11] 4,455,897

[45] Jun. 26, 1984

[54] SOCKET WRENCH DEVICE

[76] Inventor: Adrian D. Jones, Rte. 1, Box 78-A, Elberton, Ga. 30635

[21] Appl. No.: 185,755

[22] Filed: Sep. 10, 1980

[51] Int. Cl.[3] ..... B25B 13/46

[52] U.S. Cl. ..... 81/61

[58] Field of Search ..... 81/61, 58, 90 C

[56] References Cited

U.S. PATENT DOCUMENTS

| | | | |
|---|---|---|---|
| 697,321 | 4/1902 | Brown | 81/61 |
| 763,105 | 6/1904 | Morrison | 81/61 |
| 894,641 | 7/1908 | Higbee | 81/61 |
| 2,810,313 | 10/1957 | Hermanson | 81/61 |
| 3,077,801 | 2/1963 | Rostad | 81/61 |
| 3,897,701 | 8/1975 | Daniels et al. | 81/90 C |

FOREIGN PATENT DOCUMENTS

| | | | |
|---|---|---|---|
| 353977 | 7/1905 | France | 81/90 C |

*Primary Examiner*—James L. Jones, Jr.
*Attorney, Agent, or Firm*—Dority & Flint

[57] ABSTRACT

A socket wrench device is provided as including a wrench handle having a drive head which circumferentially engages a socket having a plurality of circumferentially spaced side openings facilitating use in a minimum amount of vertical space. In an advantageous form of the invention, the drive head of the wrench handle includes a ratchet drive mechanism having a plurality of pawl fingers which engage corresponding side openings in the socket.

2 Claims, 6 Drawing Figures

SOCKET WRENCH DEVICE

BACKGROUND OF THE INVENTION

Heretofore, numerous types of ratchet-type wrenches have been provided such as the conventional type which employs a square drive shaft which fits in a correspondingly shaped opening in the top of the socket. However, the problem arises that in many instances sufficient vertical space is not provided for the wrench and socket utilized in such a stacked configuration. Many wrenches have been provided which grip the object being turned from the side, however, none of these arrangements have provided in a useful socket wrench type device.

Accordingly, an important object of the present invention is to provide a socket wrench which may be utilized in a minimum amount of vertical space.

Another important object of the present invention is to provide a socket wrench which may be utilized in a minimum amount of vertical space which includes a drive head having a ratchet type drive mechanism.

Yet another important object of the present invention is to provide a socket wrench device which includes a drive head having a ratchet type drive mechanism which engages a socket from the side.

Still another important object of the present invention is to provide a socket wrench device having a simplified drive mechanism for engaging the socket about the side.

SUMMARY OF THE INVENTION

It has been found that a simplified socket and wrench device may be had by providing a socket having a plurality of side openings formed in a guide groove which guides socket engaging projections of a drive mechanism carried by a wrench handle into driving engagement with the side openings. In a preferred embodiment, the wrench handle includes an enlarged drive head having a central opening in which the socket is received and the socket engaging projections are provided in the form of pivotable pawl fingers carried within the open periphery of the drive head extending radially inwardly for engaging corresponding ones of said openings.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
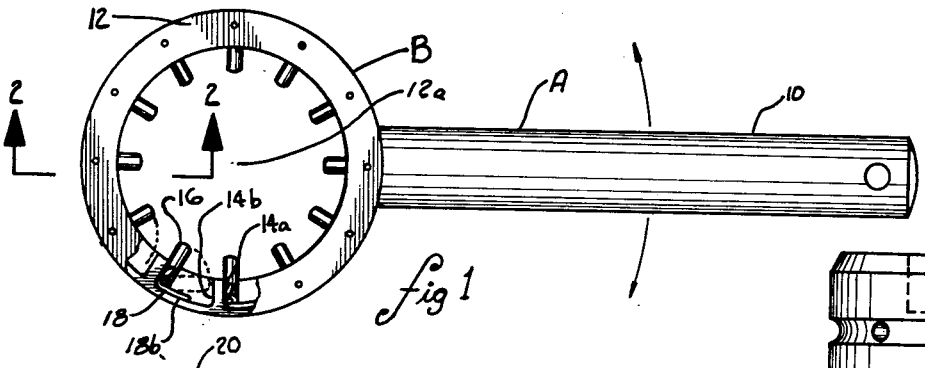
FIG. 1 is a top plan view of a wrench handle constructed according to the present invention.
Figure 3:
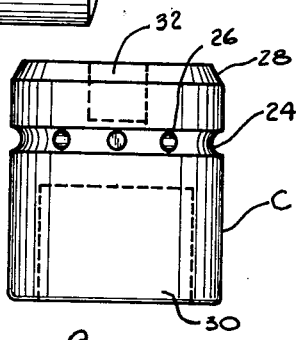
FIG. 3 is an elevation illustrating a socket constructed according to the present invention for use with the wrench handle of FIG. 1.
Figure 2:
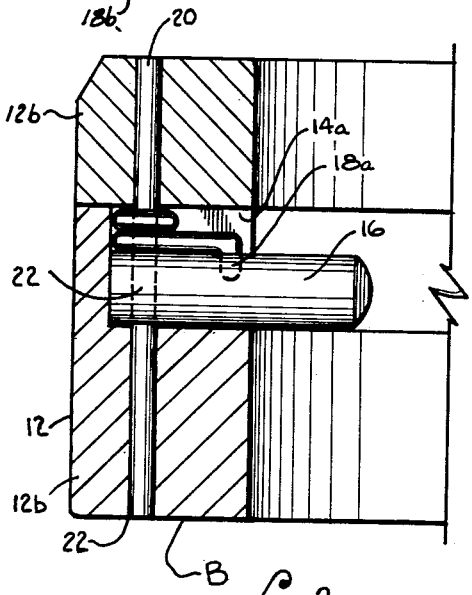
FIG. 2 is a sectional view taken along line 2—2 of FIG. 1.
Figure 4:
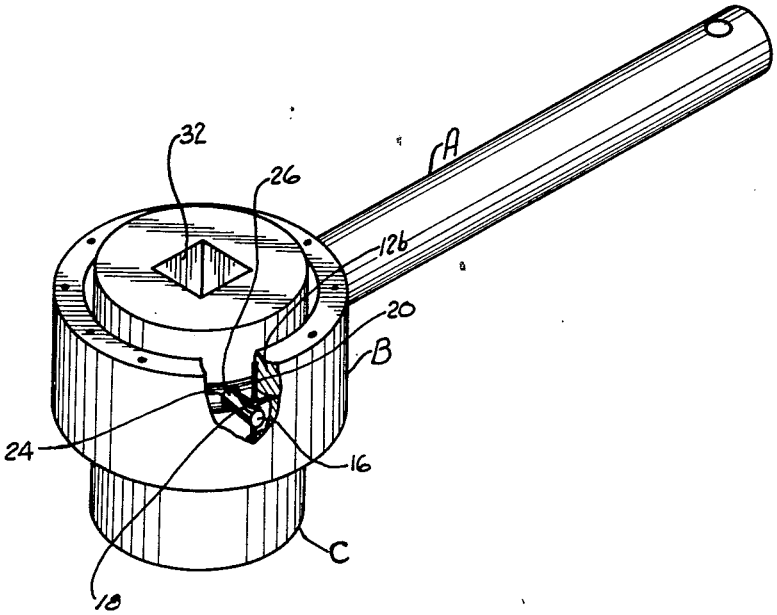
FIG. 4 is a perspective view illustrating the wrench handle and socket engaged with the drive head drive mechanism constructed in accordance with the present invention.

The invention relates to wrenches for turning nut and bolt members and the like and more particularly to a socket type wrench wherein a removable socket is utilized in combination with a wrench handle for turning such a member.

According to the invention, a socket wrench device is illustrated and disclosed which includes a wrench handle A having a drive head B carried adjacent a distal end of the wrench handle. A socket C includes a circumferential guide groove formed around an exterior side of the socket in which a plurality of circumferentially spaced side openings are located. The drive head includes a drive mechanism having an enlarged annular opening which is adapted for receiving the socket C therein. A plurality of spring-loaded pawl fingers are included in the drive mechanism and are carried radially and inwardly extending into the annular opening. The pawl fingers are adapted for engagement in corresponding side openings of the socket guide groove. The pawl fingers effect rotation of the socket when engaged therein, and the wrench handle is rotated in a first direction while disengaging gaging from the socket when rotated in a reverse direction. The engagement of the socket by the encircling drive head of the wrench handle about the exterior side thereof facilitates usage in a minimum amount of vertical space.

Referring now in more detail to the drawing, the wrench handle A is shown as including an elongated handle portion 10 integrally joined with the drive head portion B having an enlarged drive head 12 which includes a central annular opening 12*a*. Inside the inner periphery of the drive head 12 is formed a plurality of recess spaces having side walls 14*a* and 14*b*. Pivotable pawl fingers 16 are carried in the recesses and are pivotable against side 14*a* to assume a radially inwardly extending position relative to the center of central opening 12*a*. The pawl fingers 16 are biased by a spring 18 carried about a pin 20 about which the fingers 16 pivot. For this purpose, an opening 22 may be provided in the fingers which receive the pin 20 therethrough. Pins 20 are then carried in the solid circular flange portions 12*b* of the drive head 12. A vertical bore may be drilled in flange portions 12*b* with pins 20 press fitted therein. Springs 18 include a bent tab portion 18*a* which fits over the side of finger 16 and a recess engaging portion 18*b* such that the spring biases the fingers 16 against the side 14*a* of the recess generally perpendicular as shown.

Socket C includes circumferential guide groove 24 formed around the periphery of the exterior side of the socket neck in which are side openings 26. Groove 24 guides and facilitates insertion of the pawl fingers 16 in side openings 26. The socket C is advantageously provided with a beveled edge 28 which facilitates insertion within the annular opening 12*a* of the drive head 12. A standard or metric size opening 30 is formed in the socket for mating with the member being turned. By simultaneously inserting the socket and twisting the wrench handle A in a clockwise rotation as viewed from plan view of FIG. 1, the pins 16 will pivot to allow the socket head C to be received in the annular opening 12 and firngers 16 to engage in groove 24. Upon the fingers 16 being received in engage in groove 24, rotation of the handle member in the counter-clockwise direction will cause the fingers 16 to be guided and inserted into corresponding openings 26. Thereafter, further rotation of the wrench handle in the counter-clockwise direction will effect driving engagement between the fingers 16 of the drive head mechanism B and the socket C and effect rotation of the member received in opening 30 formed in socket C. Socket C may be turned in the opposite direction by reversing the drive head B over the socket.

The socket C may be further provided with standard socket opening 32 so that it will mate with a conventional socket wrench drive shaft.

Preferably, eight of the openings 26 are formed in the side of socket C. The number of pawl fingers 16 is illustrated as 12 such that the fingers fill the circumference of the socket and provide for small increments in the ratchet drive action and turning. A less number may also be utilized. Openings 26 are preferably round and may have a beveled entrance to aid in the insertion of fingers 16.

Figure 5:
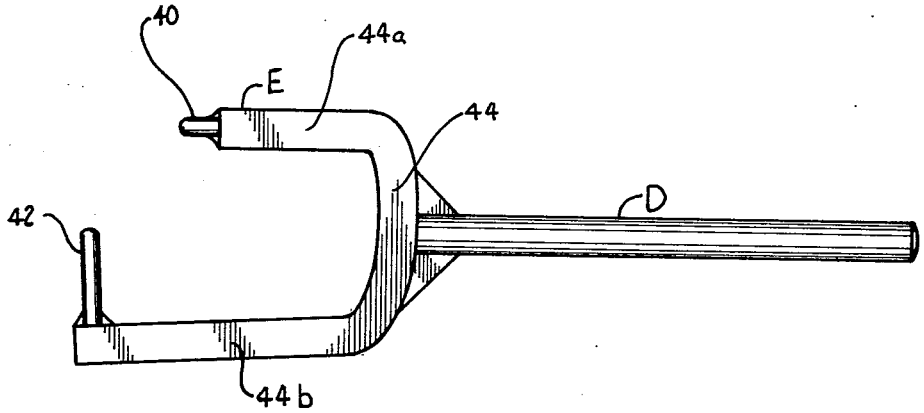
FIG. 5 is a top plan view of a wrench handle and drive head illustrating an alternate embodiment of the present invention.
Figure 6:
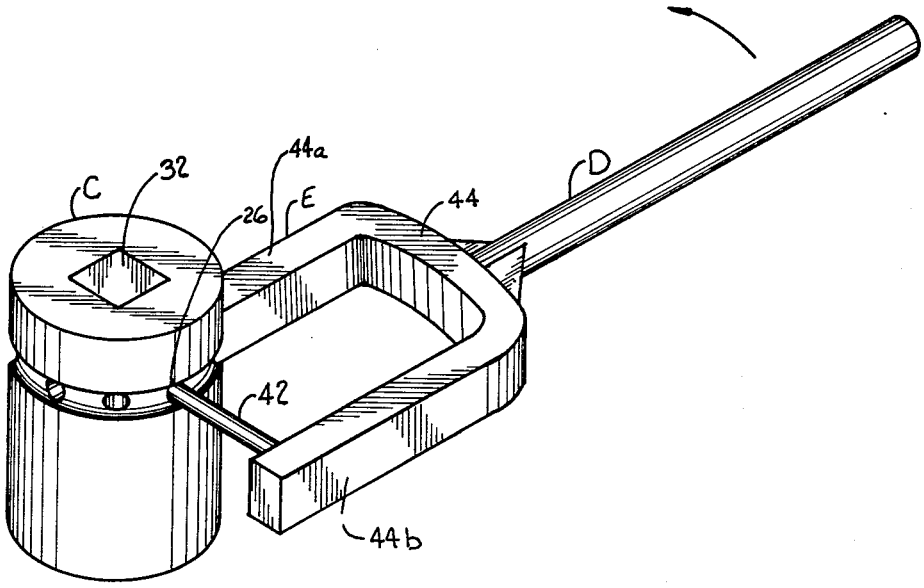
FIG. 6 is a top plan of the wrench handle of FIG. 1 in drive engagement with the socket of FIG. 3.

FIG. 5 illustrates another embodiment of the invention wherein a wrench handle D is is provided having a drive head E carried adjacent the distal end thereof. The drive head E includes a simplified drive mechanism which consists of a plurality of socket engaging projections 40 and 42 which engage only a pair of the openings 26 in socket C. The drive head E consists of a generally Y-shaped member having a base leg 44 integral with handle D, short leg 44*a* on which projection 40 is carried, and a longer leg 44*b* integral with base leg 44 upon which projection 42 is carried. While such an arrangement does not provide for a ratchet type drive, in some applications, the simplified wrench and drive mechanism will be advantageous, particularly in applications where placement of the socket upon the member to be turned with subsequent placement and engagement of the wrench handle in the socket is desired.

In use, projection 42 is inserted first in an opening 26 and arm 44*a* will reach around the side of the socket to engage projection 40 into another opening 26. Further rotation after engagement results inthe rotation of socket C.

Numerous configurations of wrench handles having straight bars which insert through diametrically opposed openings 26 may also be utilized wherein numerous bends between the handle and straight socket engaging bar are provided for a variety of applications.

While a preferred embodiment of the invention has been described using specific terms, such description is for illustrative purposes, and it is to be understood that changes and variations may be made without departing from the spirit or scope of the following claims.

What is claimed is:

1. A socket wrench device comprising:

a wrench handle;

a drive head carried adjacent an end of said wrench handle;

a removable socket having a closed continuous periphery and being open on one end for engaging and driving a nut member in rotation;

a circumferential guide groove formed inwardly around an exterior side of said socket having a bottom most surface formed therein;

a plurality of circumferentially spaced side openings located in said bottom most surface in said groove so that said groove guides pawl fingers into said openings;

said drive head including an annular opening defined by a closed peripheral wall and opposing open ends adapted for receiving said socket therein;

a drive mechanism included in said drive head having a plurality of pivotable spring-loaded pawl fingers carried radially inwardly extending into said annular opening;

said drive head including a plurality of recesses formed circumferentially therein having an opening facing into said annular opening, said recesses being defined by side portions, said pawl fingers being pivotably carried in said recesses and biased against said side portions when effecting rotation and pivoting inwardly toward said opening of said recesses in a reverse direction;

pins vertically carried in said recesses, said pawl fingers being pivotably carried by said pins;

spring means biasing said pawl fingers against said side portions;

said guide groove guiding said pawl fingers to said side openings following engagement of said pawl fingers in said groove;

said pawl fingers adapted for engagement in corresponding side openings in said groove of said socket;

said fingers effecting rotation of said socket when in engagement therewith and said wrench handle is rotated in a first direction while disengaging from said socket when rotated in said reverse direction; and said wrench handle drive head engaging said socket about said exterior side facilitating use in a minimum of vertical space.

2. The device of claim 1 including a beveled edge formed on an upper edge of said socket facilitating placement of said socket in said annular opening of said drive head mechanism.

* * * * *